United States Patent [19]

Stakelbeck

[11] Patent Number: 4,496,364

[45] Date of Patent: Jan. 29, 1985

[54] METHOD OF DYEING VOLUMINOUS SUBSTRATES WITH ANIONIC DYES

[75] Inventor: Hans-Peter Stakelbeck, Binzen, Fed. Rep. of Germany

[73] Assignee: Sandoz Ltd., Basel, Switzerland

[21] Appl. No.: 488,009

[22] Filed: Apr. 25, 1983

[30] Foreign Application Priority Data

Apr. 29, 1982 [DE] Fed. Rep. of Germany ..... 3215872
May 21, 1982 [DE] Fed. Rep. of Germany ..... 3219115

[51] Int. Cl.[3] ..... D06P 3/06; D06P 3/24

[52] U.S. Cl. ..... 8/641; 8/681; 8/683; 8/685; 8/929

[58] Field of Search ..... 8/641, 681, 685, 683, 8/929

[56] References Cited

U.S. PATENT DOCUMENTS 3,788,807 1/1974 Beiertz et al. ..... 8/685
3,912,447 10/1975 Schmidt ..... 8/681
3,953,168 4/1976 Fabbri et al. ..... 8/477
4,142,852 3/1979 Schuierer ..... 8/929
4,381,186 4/1983 Magni et al. ..... 8/929

FOREIGN PATENT DOCUMENTS 2424303 11/1975 Fed. Rep. of Germany ..... 8/929
2623178 10/1977 Fed. Rep. of Germany ..... 8/929
2641332 3/1978 Fed. Rep. of Germany ..... 8/929
2700312 7/1978 Fed. Rep. of Germany ..... 8/929
49-133678 12/1974 Japan ..... 8/609

*Primary Examiner*—Maria Parrish Tungol
*Attorney, Agent, or Firm*—Gerald D. Sharkin; Richard E. Vila; Thomas C. Doyle

[57] ABSTRACT

A process for dyeing a voluminous flat form polyamide substrate with anionic dyestuffs according to the cold pad-batch method, which process comprises the step of selecting the initial pH of the dyeing liquor within a range depending on the affinity of the substrate for anionic dyestuffs and the molecular weight of the anionic dyestuffs so as to give a substantial linear exhaustion of the dyeing liquor, the dyeing liquor being free from a thickening, swelling or foaming agent.

20 Claims, No Drawings

METHOD OF DYEING VOLUMINOUS SUBSTRATES WITH ANIONIC DYES

The present invention relates to a process for dyeing a voluminous flat form polyamide substrate with anionic dyestuffs, particularly to a dyeing process using the cold pad-batch method.

The cold pad-batch dyeing method is particularly valuable for dyeing voluminous substrates of large continuous surface area, e.g. carpets. No only are the energy savings considerable but also the appearance of the goods, particularly when the substrate is sensitive to deformation, is preserved. However, the levelness of the resulting dyeings is often unsatisfactory.

It has now been found that dyeings with improved levelness can be obtained when the initial pH of the dyeing liquor is selected within a range depending on the affinity of the substrate for the dyestuffs and the molecular weight of the dyestuffs so as to give a linear exhaustion of the dyeing liquor during the entire dyeing process.

Accordingly, the invention provides a process for dyeing a voluminous flat form polyamide substrate with anionic dyestuffs in which the substrate is treated with a dyeing liquor free from a thickening, swelling or foaming agent at a liquor-to-goods ratio below 10:1, rolled up and rotated at 20°–60° C. to effect fixation of the dyestuffs, which process comprises the step of selecting the initial pH of the dyeing liquor within a range depending on the affinity of the substrate for anionic dyestuffs and the molecular weight of the anionic dyestuffs so as to give a substantial linear exhaustion of the dyeing liquor.

Suitable polyamide substrates are those consisting of or comprising synthetic polyamides. By "synthetic polyamides" are also to be understood differential polyamides as well as the so-called "anti-soiling polyamide fibres of the 3rd or 4th generation", e.g. synthetic polyamide fibres coated with fluorocarbon polymers such as polytetrafluoroethylene. The voluminous flat form substrates are preferably carpets, e.g. woven, tufted, pile or loop pile carpets.

According to the invention, the pH of the dyeing liquor is adjusted to a value depending on the dyestuff affinity of the polyamide substrate. The synthetic polyamides are divided in three classes depending on their affinity for anionic dyestuffs:

polyamide fibre group 1 which has a high affinity for anionic dyestuffs polyamide fibre group 2 with a moderate affinity for anionic dyestuffs polyamide fibre group 3 which possesses a low affinity for anionic dyestuffs.

The affinity of the polyamide substrate for anionic dyestuffs may be assessed according to the following method.

1,000 Parts of the polyamide substrate to be tested are introduced into 40,000 parts demineralised water containing 8 parts of the commercially available dyestuff C.I. Acid Yellow 19, 6 parts of the commercially available dyestuff C.I. Acid Blue 40 and a sufficient amount of a buffer to adjust to pH 8. The substrate is dyed for 30 minutes at a temperature of from 90° to 100° C. and then rinsed.

The pH value of the dyeing liquor is adjusted to 8±0.1 at room temperature with a buffer consisting of 1,000 parts demineralised water, 5.55 parts disodium hydrogenophosphate and 0.10 parts citric acid.

Under these dyeing conditions only the dyestuff C.I. Acid Blue 40 possesses affinity for the 3 polyamide fibre groups whereas the dyestuff C.I. Acid Yellow 19 does not build up on the polyamide fibres of group 3. Thus, after dyeing according to the method indicated above, the polyamide fibres of group 1 are dyed in a green shade of a ½ standard depth and the polyamide fibres of group 3 in a blue shade of a ½ standard depth. The polyamide fibres dyed in a greenish blue or bluish-green shade belong to the fibre group 2. The blue and green shades obtained on the polyamide whose affinity is to be tested can be assessed either spectrophotometrically or by comparison with standard dyeings.

Examples of commercially available polyamide fibres which can be classified according to their affinity for anionic dyestuffs into the groups 1–3 are e.g.

for the fibre group 1:

normal "regular dyeable" polyamide 6 such as Nylon 6

"deep dyeable" polyamide 847 (Du Pont)

for the fibre group 2: "regular dyeable" Perlon® (Enka, Netherlands)

for the fibre group 3: "regular dyeable" polyamide 846 (Du Pont).

The anionic dyestuffs which are used in the process of the invention are selected according to their molecular weight and the affinity of the substrate. Preferred anionic dyestuffs are acid dyestuffs containing one or two hydrosolubilising groups, particularly one or two sulpho groups. The following dyestuff selection is particularly preferred:

polyamide fibre group 1: mono- and disulphonated acid and metal complex dyestuffs having a molecular weight from 400 to 1200;

polyamide fibre group 2: mono- and disulphonated acid dyestuffs having a molecular weight from 400 to 800; and polyamide fibre group 3: mono- or disulphonated acid dyestuffs having a molecular weight from 400 to 650.

Such dyestuffs are known from the Colour Index. Preferably the dyestuffs suitable for dyeing the polyamide fibres of group 1 have a molecular weight from 400 to 1000. Preferred metal complex dyestuffs are the 1:2 chromium or cobalt complexes of azo or azomethine dyestuffs, particularly of monoazo or azomethine dyestuffs.

According to the invention the pH of the dyeing liquor is adjusted to a value within a range depending on the two parameters defined above, i.e. the affinity of the substrate for anionic dyestuffs and the molecular weight of the dyestuffs. The following pH-ranges are particularly advantageous:

| pH-range of the dyeing liquor/MW of the dyes | 10–7 | 7–5 | 5–3 |
|---|---|---|---|
| Fibre group 1 | 400–650 | 650–800 | 800–1200 |
| Fibre group 2 | — | 400–650 | 650–800 |
| Fibre group 3 | — | — | 400–650 |

When the substrate comprises a mixture of two or three of the indicated fibre groups, the pH of the dyeing liquor is adjusted to an average value. In the case where the polyamide substrate to be dyed comprises a mixture of the fibre groups 1 and 2, the pH of the dyeing liquor is preferably adjusted to a value from 7 to 7.5. When a mixture of the groups 2 and 3 is to be dyed, the pH of the dyeing liquor is preferably adjusted to a value from 5 to 5.5. In the case where the substrate comprises a mixture of groups 1 and 3 or 1, 2 and 3, the pH of the dyeing liquor is preferably adjusted to 6–6.5.

According to a preferred embodiment of the invention when a trichromic dyeing of plain goods is desired, mono- or disulphonated, preferably monosulphonated acid dyestuffs having a molecular weight within the range 400–650 and differing from one another by at most 100 units are used. Further preferred trichromic dyestuffs are those having a neutral build-up of from 80 to 90% by weight and a non-migrating part of at most 10% by weight.

The dyeing liquor is adjusted to the selected pH-value before it is applied onto the substrate. The adjustment of the pH can be carried out according to known methods, e.g. with an alkaline or acid agent such as sodium carbonate or a mineral or organic acid, e.g. acetic acid, depending on the desired pH-conditions. The dyeing is carried out in the absence of any acid or base donating agent.

The dyeing liquor may be applied onto the substrate according to known methods, e.g. dipping, pouring or spraying, preferably pouring. Padding is not preferred.

In the process of the invention, the liquor-to-goods ratio is preferably within the range from 1:1 to 5:1, more preferably 1.5:1 to 3:1. In addition to the dyestuffs and the acid or alkaline compound, the dyeing liquor may contain further dyeing assistants, e.g. a wetting agent or a levelling agent, with the proviso that these compounds are not a foaming, thickening or swelling agent and do not increase the viscosity of the dyeing liquor.

In the absence of any thickening agent or assistant having thickening properties, the dyeing liquor flows during the rotation in the rolled-up substrate. The transport of the dyeing liquor is ensured by the amount of liquor present, the low viscosity of the aqueous non-thickening liquor and the rotation speed of the substrate. Due to its low viscosity, the dyeing liquor tends to accumulate in a regularly renewed small volume at the lower part of the roll. This partial accumulation remains constant in volume but its dyestuff concentration decreases as time elapses. The rotation conditions of the rolled-up substrate preferably remain identical during the whole rotation period which may be of from 1 to 48 hours.

The rotation of the rolled-up substrate may be about any longitudinal axis, preferably about the axis of the roll of substrate which itself is in the horizontal or substantially horizontal phase. The speed of rotation is of from 1.5 to 4 r.p.m. so as to avoid undue centrifugal force, preferably 3 r.p.m. The flowing of the dyeing liquor in the rotated substrate ensures an optimal distribution of the dyeing liquor. Before the substrate is rotated, it is recommended to wrap it in a plastic sheet to avoid dryness.

According to the invention, linear exhaustion of the dyeing liquor is substantially obtained when the pH-value of the dyeing liquor is selected as indicated. In a preferred embodiment of the invention, a further parameter can be selected accordingly. It has been found that the rotation time necessary to obtain substantial fixation of the dyestuffs can be evaluated as follows $$V = \frac{F \cdot M}{-300} (\mathrm{pH} + D)$$

wherein

V = rotation time in hours

F = polyamide fibre group or average value in the case of a mixture

M = molecular weight of the anionic dyestuff or the average molecular weight in the case of a mixture of anionic dyestuffs D = total amount of dyestuff in % by weight based on the weight of the substrate.

Preferably the parameters of the above equation are selected within the indicated ranges so as to obtain a linear exhaustion of the dyeing liquor for a rotation time, i.e. the fixation time, of from 12 to 24 hours. A preferred temperature for the rotation is from 20° to 40° C.

After fixation of the dyestuffs has taken place, the substrate may be dried in conventional manner or, if desired, freed from any remaining liquor by washing or hydro-extraction. Generally it is sufficient to spray the substrate with a small amount of water and then to dry.

According to a preferred aspect of the invention, the dyed substrate is subjected after fixation of the dyestuffs and before the drying step to an after-treatment with saturated steam at 98° to 105° C. for 30 to 300 seconds. This after-treatment of the dyeings can be carried out before or after the washing step if such is effected. The after-treatment is particularly recommended when the substrate comprises synthetic polyamide fibres of group 3.

If desired, the bulk of the substrate can be improved by treating the substrate before dyeing, with saturated steam at 98° to 105° C. for 30 to 300 seconds.

The dyeing process of the invention displays all the advantages of dyeing voluminous flat form substrate with a low liquor ratio through the cold pad-batch method. It is of particular interest that, by the specific selection of the pH of dyeing liquor in connection with the molecular weight of the dyestuffs and the fixation time, dyeings having a high degree of levelness and good fastness properties are obtained on the various polyamide fibre groups and mixtures. When dyeing differential polyamides, dispersion or basic dyestuffs may be applied together with the acid dyestuffs according to the invention. The process of the invention leads on differential polyamides to a good differentiation of the shades. Furthermore, the process makes considerable time savings achievable since the fixation period can be calculated. The dyeing conditions according to the invention used for disulphonated acid dyestuffs having a high molecular weight and metal complex dyestuffs give dyeings with good properties whereas such dyestuffs were reluctantly used in the hitherto known cold pad-batch processes. Also mixtures of monosulpho- and disulphonated dyestuffs can be used. Furthermore, interesting multicoloured effects may be obtained when the process of the invention is used for ground dyeing a substrate which has been locally dyed, printed or reserved (including the fixation of these local dyeings or printings).

The following Examples, in which all parts and percentages are by weight and all temperatures are in degrees Centigrade, illustrate the invention.

EXAMPLE 1

An aqueous liquor adjusted to pH 10 and containing per 1,000 parts:

| | |
|---|---|
| 0.1% | 0.3 parts C.I. Acid Orange 156 (MW = 440)<br>0.03 parts C.I. Acid Red 57 (MW = 526)<br>0.12 parts C.I. Acid Blue 72 (MW = 451)<br>2.00 parts of a commercially available wetting agent based on a sodium alkylsulphate and<br>0.2 parts sodium carbonate calc. |

is poured at a ratio of 250% (based on the weight of the dry carpet) on a plain velvet carpet consisting of polyamide 6 fibre group 1 and having a synthetic backing. The carpet is then rolled up, wrapped in a plastic sheet and rotated at room temperature for 16 hours at 3 r.p.m. During this period a substantial linear exhaustion is obtained. After rinsing and drying, there is obtained an evenly beige dyed carpet.

EXAMPLE 2

An aqueous liquor adjusted to pH 4.8 and containing per 1,000 parts:

| | |
|---|---|
| 0.3% | 0.55 parts C.I. Acid Orange 156<br>0.29 parts C.I. Acid Red 57<br>0.37 parts C.I. Acid Blue 72<br>2.00 parts of a commercially available wetting agent based on a sodium alkylsulphate and<br>0.6 parts 60% acetic acid |

is poured on a velvet carpet of polyamide 6.6 fibre group 3 having a synthetic backing and previously pretreated with saturated steam for 50 seconds. The liquor absorption amounts to 250% in relation to the weight of the dry carpet.

The carpet is then rolled-up, wrapped in a plastic sheet and rotated at room temperature for 24 hours at 3 r.p.m., a period during which a substantial linear exhaustion of the dyeing liquor is obtained.

After washing and drying, the resulting carpet is evenly dyed in a brown shade having good fastness properties.

EXAMPLE 3

A velvet carpet of polyamide 6 fibre group 2 with a synthetic backing is treated as described in Example 1 with a dyeing liquor containing the same dyestuffs and additive but adjusted to pH 7. The rolled-up carpet is rotated for 22 hours.

EXAMPLE 4

A velvet carpet of polyamide 6 fibre group 2 with a synthetic backing is treated as described in Example 1 with a dyeing liquor containing the dyestuffs and wetting agent of Example 1 and adjusted to pH 5, the total amount of dyestuffs being 2% by weight. The fixation time is 22 hours.

EXAMPLE 5

An aqueous liquor adjusted to pH 4.7 and containing per 1,000 parts:

| | |
|---|---|
| 0.57% | 0.4 parts C.I. Acid Yellow 196 (MW = 427)<br>1.2 parts C.I. Acid Orange 156<br>0.13 parts C.I. Acid Blue 72<br>1.0 parts C.I. Basic Orange 58<br>3.0 parts of a commercially available non-ionic wetting agent based on an ethylene oxide addition product |

-continued

| | |
|---|---|
| | 2.0 parts of a cationic/non-ionic levelling agent based on a polyglycol ether, and<br>0.7 parts 60% acetic acid |

is poured on a loop pile carpet comprising polyamide 6.6 fibres of group 3 and basic dyeable fibres and having a synthetic backing. Before the treatment with the dyeing liquor the carpet has been subjected to saturated steam for 50 seconds.

The liquor absorption amounts to 210% based on the weight of the carpet. The carpet is then rolled-up and treated as described in Example 2. There is obtained after 24 hour rotation an evenly dyed carpet with a green/orange differentiation.

EXAMPLE 6

An aqueous liquor adjusted to pH 5 and containing, per 1000 parts:

| | |
|---|---|
| 0.8% | 1.50 parts C.I. Acid Orange 156<br>0.3 parts C.I. Acid Red 57<br>1.50 parts C.I. Acid Blue 182 (MW = 545)<br>0.50 parts C.I. Basic Orange 57<br>3.0 parts of a commercially available non-ionic wetting agent based on an ethylene oxide addition product<br>2.0 parts of a cationic/non-ionic levelling agent based on a polyglycol ether<br>3.0 parts of a mixture comprising<br>8 parts benzyl alcohol<br>9 parts monophenylglycol ether and<br>3 parts octylphenylpentaglycol ether, and<br>0.1 parts 60% acetic acid |

is poured on a loop pile carpet comprising polyamide 6 fibres of groups 2 and 3 and basic dyeable fibres and having a synthetic backing. The carpet is treated as described in Example 2 except that it is rotated for 24 hours.

An evenly brown-gold dyed carpet with a very good differentiation is obtained.

EXAMPLE 7

An aqueous liquor adjusted to pH 4.5 and containing per 1,000 parts:

| | |
|---|---|
| 0.24% | 0.7 parts C.I. Acid Orange 156<br>0.15 parts C.I. Acid Red 57<br>0.31 parts C.I. Acid Blue 72<br>3.0 parts of a commercially available non-ionic wetting agent based on an ethylene oxide addition product<br>2.0 parts of a cationic/non-ionic levelling agent based on a polyglycol ether and<br>1.0 parts 60% acetic acid |

is poured on a loop pile carpet of polyamide 6.6 fibre group 3 having a synthetic backing. The liquor absorption amounts to 210% based on the weight of the carpet.

The carpet is then rolled-up and rotated for 22 hours at 3 r.p.m. Subsequently the carpet is heated with saturated steam for a period from 30 to 300 seconds, washed and dried. There is obtained an evenly dyed carpet having good fastness properties.

EXAMPLE 8

An aqueous liquor adjusted to pH 5 and containing per 1,000 parts:

| | | |
|---|---|---|
| 1.42% | 1.60 | parts C.I. Acid Yellow 151 (MW = 800) |
| | 2.60 | parts C.I. Acid Red 217 (MW = 908) |
| | 1.50 | parts C.I. Acid Black 218 (MW = 924) |
| | 3.0 | parts of a commercially available non-ionic wetting agent based on an ethylene oxide addition product |
| | 2.0 | parts of a cationic/non-ionic levelling agent based on a polyglycol ether, and |
| | 1.0 | parts 60% acetic acid |

is poured on a carpet of polyamide 6 fibre group 1 with a liquor absorption of 250%. The dyestuff used are metal complex dyes.

The carpet is then rolled-up and rotated for 19 hours at room temperature at 3 r.p.m. After washing and drying, there is obtained an evenly dyed carpet with a brown shade having good fastness properties.

EXAMPLE 9

An aqueous liquor adjusted to pH 3 and containing, per 1,000 parts:

| | | |
|---|---|---|
| 2.14% | 2.60 | parts C.I. Acid Red 57 |
| | 18.80 | parts C.I. Acid Blue 72 |
| | 10.0 | parts of a commercially available non-ionic wetting agent based on an ethylene oxide addition product, and |
| | 20.0 | parts 60% acetic acid |

is poured on a non-woven of polyamide 6.6 of the fibre group 3. The liquor absorption amounts to 100% based on the weight of the non-woven substrate.

The substrate is then rolled-up, wrapped in a plastic sheet and rotated for 25 hours at 3 r.p.m. Subsequently the substrate is treated with saturated steam for 30–300 sec., washed and dried.

A polyamide 6.6 non-woven, evenly dyed in a blue shade is obtained.

EXAMPLE 10

An aqueous liquor adjusted to pH 3 and containing, per 1,000 parts:

| | | |
|---|---|---|
| 0.8% | 1.50 | parts C.I. Acid Orange 156 |
| | 0.3 | parts C.I. Acid Red 57 |
| | 1.50 | parts C.I. Acid Blue 182 |
| | 3.0 | parts of a commercially available non-ionic wetting agent based on an ethylene oxide addition product, |
| | 3.0 | parts of the mixture of Example 6, and |
| | 6.0 | parts 60% acetic acid |

is poured with 250% absorption on a polyamide 6.6 carpet containing fibres of the group 3. This carpet has previously been subjected to a local dyeing or printing step with a fibre-reactive reserving agent, a synthetic tanning agent or an acid dye having poor migration properties followed by a fixation treatment.

The carpet is then rolled-up, wrapped in a plastic sheet and rotated for 19 hours at room temperature at a speed of 3 r.p.m.

There is obtained a carpet ground dyed in an even brown shade and comprising local white reserving or multicoloured effects with sharp outlines.

EXAMPLE 11

A polyamide 6.6 carpet comprising basic dyeable fibres and fibres of the group 3 coated with fluorocarbon polymers is, after subjecting to a treatment with saturated steam for 50 seconds and then with 40% cold water, sprayed with an aqueous liquor adjusted to pH 4.7 and containing per 1000 parts the same ingredients and dyestuffs as described in Example 5. The liquor adsorption amounts to 210% based on the weight of the carpet. The carpet is then rolled-up and treated according to Example 2.

An evenly dyed carpet with a good green/orange differentiation is obtained.

EXAMPLE 12

An aqueous liquor adjusted to pH 9 and containing per 1,000 parts:

| | | |
|---|---|---|
| 0.34% | 0.55 | parts C.I. Acid Orange 156 |
| | 0.29 | parts C.I. Acid Red 57 |
| | 0.37 | parts C.I. Acid Blue 72 |
| | 0.50 | parts C.I. Basic Orange |
| | 3.0 | parts of a commercially available non-ionic wetting agent based on an ethylene oxide addition product |
| | 2.0 | parts of a cationic/non-ionic levelling agent based on polyglycol ether |
| | 3.0 | parts of the mixture of Example 6, and |
| | 0.10 | parts sodium carbonate calc. |

is poured on a woven velvet carpet having a polypropylene backing and containing polyamide 6 fibres of group 1 and basic dyeable fibres. The liquor absorption amounts to 200% based on the weight of the substrate.

The carpet is then rolled-up and rotated at room temperature for 15 hours at a speed of 3 r.p.m. After washing and drying, the resulting carpet is evenly dyed in a beige-gold shade.

What is claimed is:

1. In a process wherein a dyeing liquor containing one or more anionic dyestuffs is applied to a voluminous flat form synthetic polyamide substrate at a liquor:-goods ratio below 10:1 and the thus-treated substrate is rolled up and rotated at a temperature of 20°–60° C. to effect fixation of the dyestuff, the improvement which comprises (1) employing a dyeing liquor which contains no thickening, swelling or foaming agent and which has an initial pH within a range, depending on the affinity of the substrate for anionic dyestuffs and on the molecular weight of the anionic dyestuffs, as will give a substantially linear exhaustion of the dyeing liquor, and (2) applying the dyeing liquor to the substrate in an amount such that it flows on the rolled-up substrate during the rotation thereof.

2. A process according to claim 1, in which the anionic dyestuffs are acid dyestuffs.

3. A process according to claim 2, in which monosulphonated acid dyestuffs having a molecular weight within the range 400–650 and differing from one another by at most 100 units, a neutral build-up of from 80 to 90% by weight and a non-migrating part of at most 10% by weight are used for trichromic dyeing.

4. A process according to claim 1, in which the dyed substrate is subjected after fixation of the dyestuffs to an aftertreatment with saturated steam for 30 to 300 seconds.

5. A process according to claim 1 wherein the rolled-up substrate is rotated about a substantially horizontal longitudinal axis.

6. A process according to claim 5 wherein, during the rotation of the rolled-up substrate, a regularly renewed small volume of the dyeing liquor tends to accumulate at the lower part of the roll and the dyestuff concentration of said small volume decreases during the rotation.

7. A process according to claim 6 wherein the anionic dyestuff is selected from mono- and disulphonated acid and metal complex dyestuffs having a molecular weight from 400 to 1200 where the polyamide substrate is of fiber group 1 which has a high affinity for anionic dyestuffs, mono- and disulphonated acid dyestuffs having a molecular weight from 400 to 800 where the polyamide substrate is of fiber group 2 which has a moderate affinity for anionic dyestuffs, and mono- and disulphonated acid dyestuffs having a molecular weight from 400 to 650 where the polyamide substrate is of fiber group 3 which has a low affinity for anionic dyestuffs.

8. A process according to claim 7 wherein any metal complex dyestuff is a 1:2 chromium or cobalt complex of an azo or azomethine dyestuff.

9. A process according to claim 6 where in the liquor:goods ratio is in the range 1:1 to 5:1.

10. A process according to claim 6 wherein the rolled-up substrate is rotated at a speed of 1.5 to 4 rpm.

11. A process according to claim 1 wherein the anionic dyestuff is selected from mono- and disulphonated acid and metal complex dyestuffs having a molecular weight from 400 to 1200 where the polyamide substrate is of fiber group 1 which has a high affinity for anionic dyestuffs, mono- and disulphonated acid dyestuffs having a molecular weight from 400 to 800 where the polyamide substrate is of fiber group 2 which has a moderate affinity for anionic dyestuffs, and mono- and disulphonated acid dyestuffs having a molecular weight from 400 to 650 where the polyamide substrate is of fiber group 3 which has a low affinity for anionic dyestuffs.

12. A process according to claim 11 wherein any metal complex dyestuff is a 1:2 chromium or cobalt complex of an azo or azomethine dyestuff.

13. A process according to claim 11, in which the initial pH is selected as follows:

| pH-range of the dyeing liquor/MW of the dyes | 10–7 | 7–5 | 5–3 |
|---|---|---|---|
| Fibre group 1 | 400–650 | 650–800 | 800–1200 |
| Fibre group 2 | — | 400–650 | 650–800 |
| Fibre group 3 | — | — | 400–650 |

14. A process according to claim 13, in which the pH of the dyeing liquor is adjusted to a value from 7 to 7.5 when the substrate comprises a mixture of the fibre groups 1 and 2, to a value from 5 to 5.5 when the substrate comprises a mixture of the fibre groups 2 and 3, or to a value from 6 to 6.5 when the substrate comprises a mixture of the fibre groups 1 and 3 or 1, 2 and 3.

15. A process according to claim 13 wherein any metal complex dyestuff is a 1:2 chromium or cobalt complex of an azo or azomethine dyestuff.

16. A process according to claim 13 wherein the rolled-up substrate is rotated about a substantially horizontal longitudinal axis and during the rotation, a regularly renewed small volume of the dyeing liquor tends to accumulate at the lower part of the roll and the dyestuff concentration of said small volume decreases during the rotation.

17. A process according to claim 16 wherein the liquor:goods ratio is in the range 1:1 to 5:1.

18. A process according to claim 16 wherein the rolled-up substrate is rotated at a speed of 1.5 to 4 rpm.

19. A process according to claim 11, in which the fixation time is given by $$V = \frac{F \cdot M}{-300} (\mathrm{pH} + D)$$

wherein

V = rotation time in hours

F = polyamide fibre group or number average value in the case of a mixture

M = molecular weight of the anionic dyestuff or the average molecular weight in the case of a mixture of anionic dyestuffs D = total amount of dyestuff in % by weight based on the weight of the substrate.

20. A process according to claim 11 wherein the rolled-up substrate is rotated about a substantially horizontal longitudinal axis and during the rotation, a regularly renewed small volume of the dyeing liquor tends to accumulate at the lower part of the roll and the dyestuff concentration of said small volume decreases during the rotation.

* * * * *